US005923927A

United States Patent [19]

Hwang

[11] Patent Number: 5,923,927

[45] Date of Patent: Jul. 13, 1999

[54] BRACKETS AND ONE PIECE FRAMES FOR A TONER FIXING DEVICE IN AN ELECTROPHOTOGRAPHIC APPARATUS

[75] Inventor: Tae-Heum Hwang, Seoul, Rep. of Korea

[73] Assignee: SamSung Electronics Co., Ltd., Suwon, Rep. of Korea

[21] Appl. No.: 08/922,307

[22] Filed: Sep. 2, 1997

[30] Foreign Application Priority Data

Sep. 2, 1996 [KR] Rep. of Korea ..... 96-37911

[51] Int. Cl.[6] ..... G03G 15/16

[52] U.S. Cl. ..... 399/122; 399/320

[58] Field of Search ..... 399/122, 320, 399/328, 330; 219/216, 469, 470, 471

[56] References Cited

U.S. PATENT DOCUMENTS 4,121,089 10/1978 Bishop ..... 219/216
4,259,920 4/1981 Sasaki .
4,782,359 11/1988 Tomoe ..... 399/122
4,812,873 3/1989 Inagaki .
4,965,640 10/1990 Watarai .
5,045,887 9/1991 Nakamura ..... 399/122
5,201,852 4/1993 Ogoshi ..... 399/122 X
5,528,345 6/1996 Hasegawa ..... 399/122
5,543,905 8/1996 Oda .
5,578,098 11/1996 Noguchi et al. .
5,708,926 1/1998 Sagara et al. ..... 399/122

*Primary Examiner*—S. Lee
*Attorney, Agent, or Firm*—Robert E. Bushnell, Esq.

[57] ABSTRACT

A fixing device for an electrophotographic apparatus, that uses both heat and pressure to fix a toner image onto a sheet of paper. The heat and pressure rollers are supported by a one piece frame which attaches to a bracket inside the electrophotographic apparatus. The one piece frame has slots in it where a spring is attached to increase the force of the pressure roller upon the heating roller.

16 Claims, 4 Drawing Sheets

BRACKETS AND ONE PIECE FRAMES FOR A TONER FIXING DEVICE IN AN ELECTROPHOTOGRAPHIC APPARATUS

CLAIM OF PRIORITY

This application makes reference to, incorporates the same herein, and claims all rights accruing thereto under 35 U.S.C. §121 through my patent application entitled *Toner Fixing Device in an Electrophotographic Apparatus* earlier filed in the Korean Industrial Property Office on the 2nd day of September 1996 and there duly assigned Ser. No. 1996/37911.

BACKGROUND OF THE INVENTION

1. Field of the Invention

The present invention relates to a device for an electrophotographic apparatus and, more particularly, to a toner fixing device having a one piece frame supporting the fixing device's rollers.

2. Background Art

To transfer an image to a sheet of paper, the typical electrophotographic apparatus uses a photosensitive drum with a surface that becomes conductive when exposed to light. The drum is charged by a charging roll and then selectively exposed to light by an exposing unit. This creates an latent electrostatic image on the photosensitive drum. A developer then adds fine toner particles to the electrostatic image forming a latent toner image. The toner image is then transferred to a sheet of paper by a high pressure toner image transfer unit. The toner image is then fixed and melted onto the paper by a fixing device. The typical fixing device has a heating roller which fuses the toner image into the paper and a pressure roller for pressing the sheet against the heating roller. The heating roller is cylindrical and has a heating element, such as a halogen lamp, which keeps the heating roller at the necessary temperature to melt the toner particles into the paper. A typical temperature for the surface of the roller is somewhere around 150° and 200° C. The heating roller and the pressure roller rotate in the opposite direction so as to nip a piece of paper between the two rollers. After the image is fixed, the paper is discharged by a discharge roll unit to a collector tray.

The development of electrophotographic copiers has led to a corresponding development of many different types of fixing devices. Initially the ends of the rollers were supported by two piece frames, which led to a certain lack of dimensional precision. This led to the use of one piece frames in some fixing devices. For example, U.S. Pat. No. 4,965,640 to Watarai entitled *Image Forming Apparatus Including Detachable Toner Fixing Unit*, mentions a detachable heat and pressure fixing device that has the ends of both rollers supported by one piece frames. Another example of a removable heat and pressure fixing device using one piece frames to support the ends of its rollers is shown in U.S. Pat. No. 5,579,098 to Noguchi entitled *Image Forming Apparatus with Removable Fixing Unit*. U.S. Pat. No. 4,259,920 to Sasaki entitled *Toner Image Pressure Fixing Device*, shows a one piece frame which supports an end of two pressure rollers and has a spring located in a slot of the frame. Both U.S. Pat. No. 5,543,905 to Oda entitled *Toner Fixing Device for Image Forming Apparatus* and U.S. Pat. No. 4,812,873 to Inagaki entitled *Heat Fixing Unit in an Electrophotographic Copying Apparatus*, show a heat and pressure fixing device with one piece frames supporting the ends of the rollers.

I have observed that what is needed but so far unaddressed by the art is a heat and pressure fixing device that supports the ends of its roller with one piece frames, that has a spring located in a slot in each one piece frame for increasing the pressure between the rollers, and that is attachable to the electrophotographic apparatus using mounting brackets. I expect that such a fixing device will increase the dimensional accuracy of the fixing device and simplify the manufacturing process.

SUMMARY OF THE INVENTION

It is an object of the present invention to provide a fixing device that eliminates some of the dimensional imprecision that normally occurs during manufacture by using one piece frames to support the ends of the fixing devices's rollers;

It is another object to provide a fixing device that can attach to a bracket inside the electrophotographic apparatus, thus simplifying the manufacturing process;

It is yet another object to use one piece frames that have slots which contain springs to increase the pressure between the two roller;

These and other objects can be achieved by using a heat pressure fixing device that uses one piece frames to support the ends of the rollers. The one piece frames each have two slots in their rectangular bodies. The second slot being narrower and adjacent to the first. A spring is located in the one piece frame on the surface adjacent to the second slot. The one piece frames are designed to engage the mounting brackets inside the electrophotographic apparatus. The use of the one piece frame should increase the dimensional precision of the fixing devices and simplify the manufacturing process.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
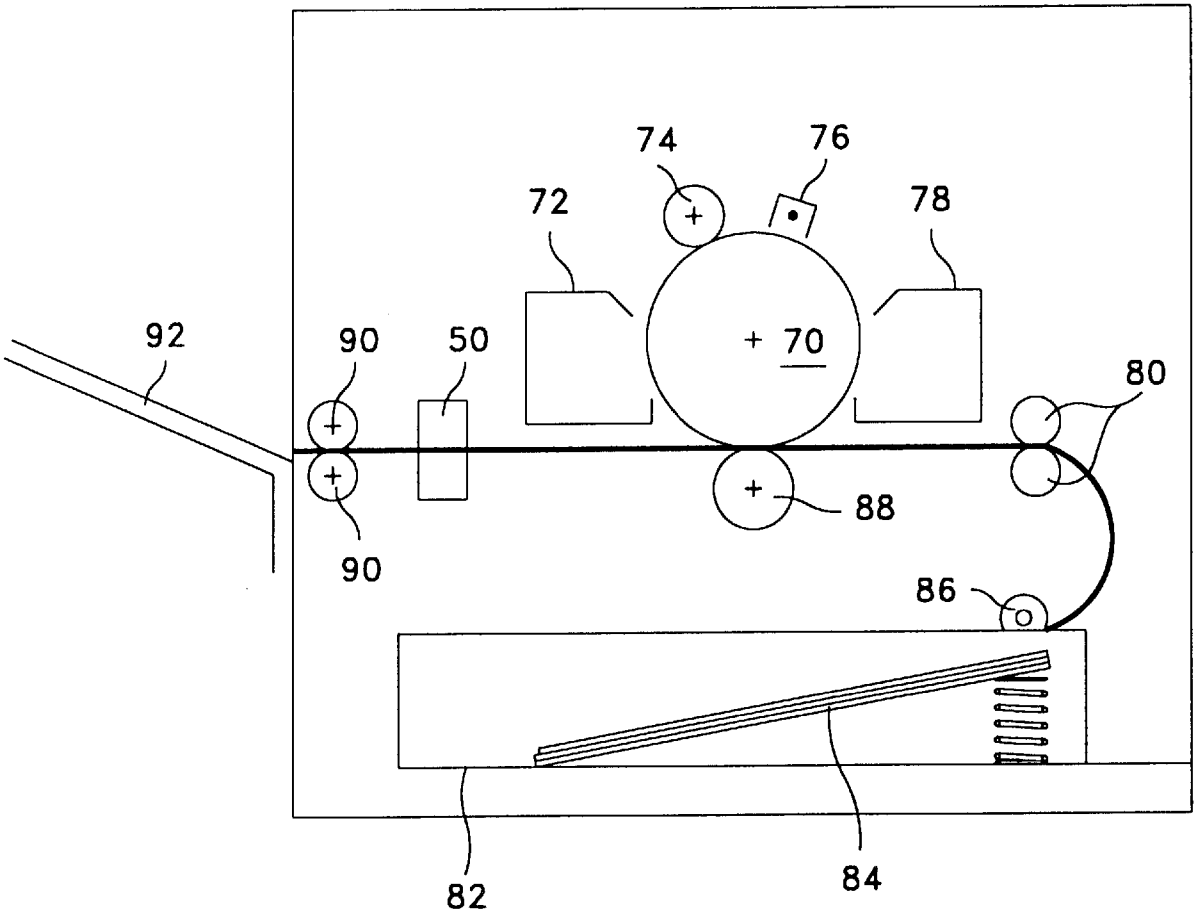
FIG. 1 is a schematic diagram of an exemplary electrophotographic apparatus.

Turning now to the drawings, particularly FIG. 1, which illustrates a typical electrophotographic apparatus. The surface of the photosensitive drum 70 is uniformly charged by a corona discharge from the charging roll 74. The surface of the photosensitive drum 70 is then selectively exposed to light by the exposing unit 76, thus forming an electrostatic latent image. The latent image formed on the surface of the photosensitive drum 70 passes through the developer 78 that attaches toner particles to form a latent toner image. Then, a sheet of paper 84 is picked up by a pickup roll 86 from the paper tray 82 and fed to the conveyor roll unit 80. They conveyor roll unit transports the paper to the toner image transfer roll 88 that presses the paper 84 against the toner image on the photosensitive drum 70. The paper 84, along with the impressed toner image, is then passed through a fixing device 50. The fixing device has both heating and pressure rolls that fix the toner image to the paper using both heat and pressure. Subsequently, the printed sheet 84 is ejected by a discharging roll unit 90 onto a collector tray 92. During the fixing of the image to the paper and the ejection of the paper, the residual toner particles on the photosensitive drum 70 are removed by a cleaner 72 after passing the transfer roll unit. The electrostatic latent image is also removed by a charge removal lamp.

Figure 2:
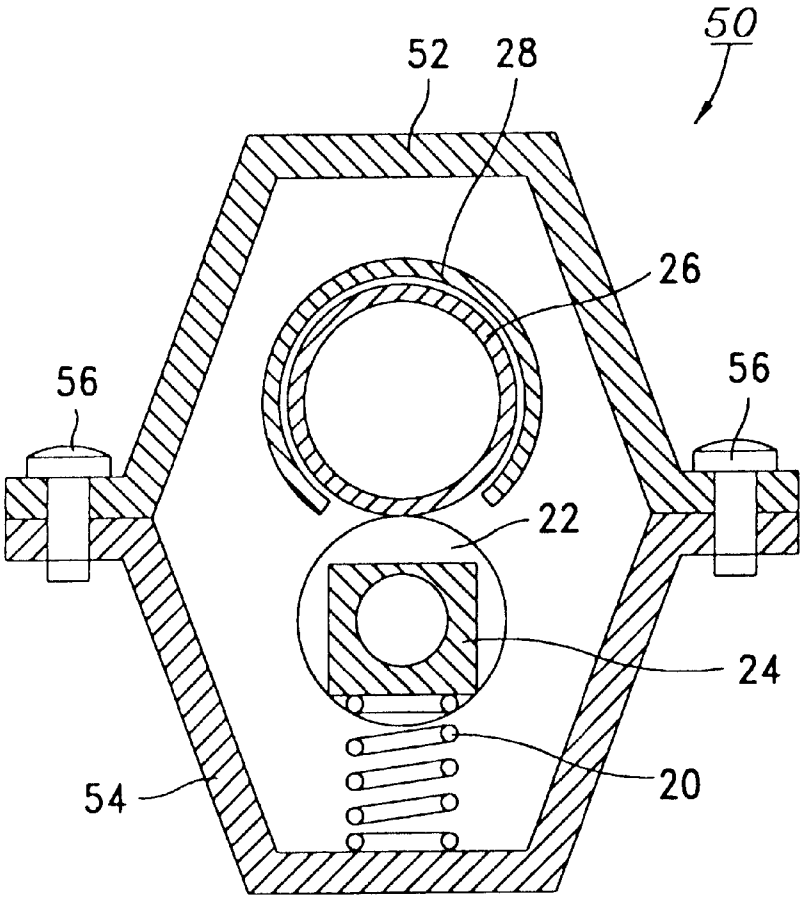
FIG. 2 is a side cross-sectional view of an exemplary toner fixing device.

In the typical electrophotographic apparatus, the toner fixing device 50 includes a heating roll 26 and a pressure roll 22, as shown in FIG. 2 The pressure roll 22 is mounted on a lower frame 54 of the toner fixing device. The pressure roll 22 has abrasion resistant pads 24 on its ends to prevent wear from the frame due to the rotation of the roller. The heating roll 26 is mounted on the upper frame 52 of the toner fixing device 50. The heating roll 26 contains a halogen lamp that heats the roller to the necessary temperature to melt the toner into the paper. The heating roll also has an abrasion resistant lining 28. The pressure roller 22 is pushed by a spring 20 against the heating roll 26.

The assembly of a typical fixing device starts with the heating roll 26, and associated abrasion resistant lining 28, being mounted to the upper frame 52. The abrasion resistant lining is attached to both sides of the upper frame 52 in a manner that does not impede the rotation of the heating roll 26. After attaching the pressure spring on the inside bottom of the lower frame 54, the pressure roll 22, with abrasion resistant pads 24 on both ends, is attached to the lower frame 54. Then, the upper frame 52 and lower frame 54 are fastened together by screws 56 that are inserted into both sides of the upper frame 52 and the lower frame 54. This causes the pressure spring 20 to be compressed thereby creating a constant force that pushes the pressure roll 22 towards the heating roll 26.

During the operation of the electrophotographic apparatus a sheet of paper 84, already impressed with a toner image, is guided between the heating roll 26 and the pressure roll 2. This fixes the toner image onto the paper. However, such two frame fixing devices can exert different amounts of pressure on the paper because the force of the spring 20 varies with the dimensional precision of the upper and lower frames 52 and 54. This can lead to a lock of uniformity in toner image fixing and thereby degrade the printing quality of the electrophotographic apparatus.

Figure 3:
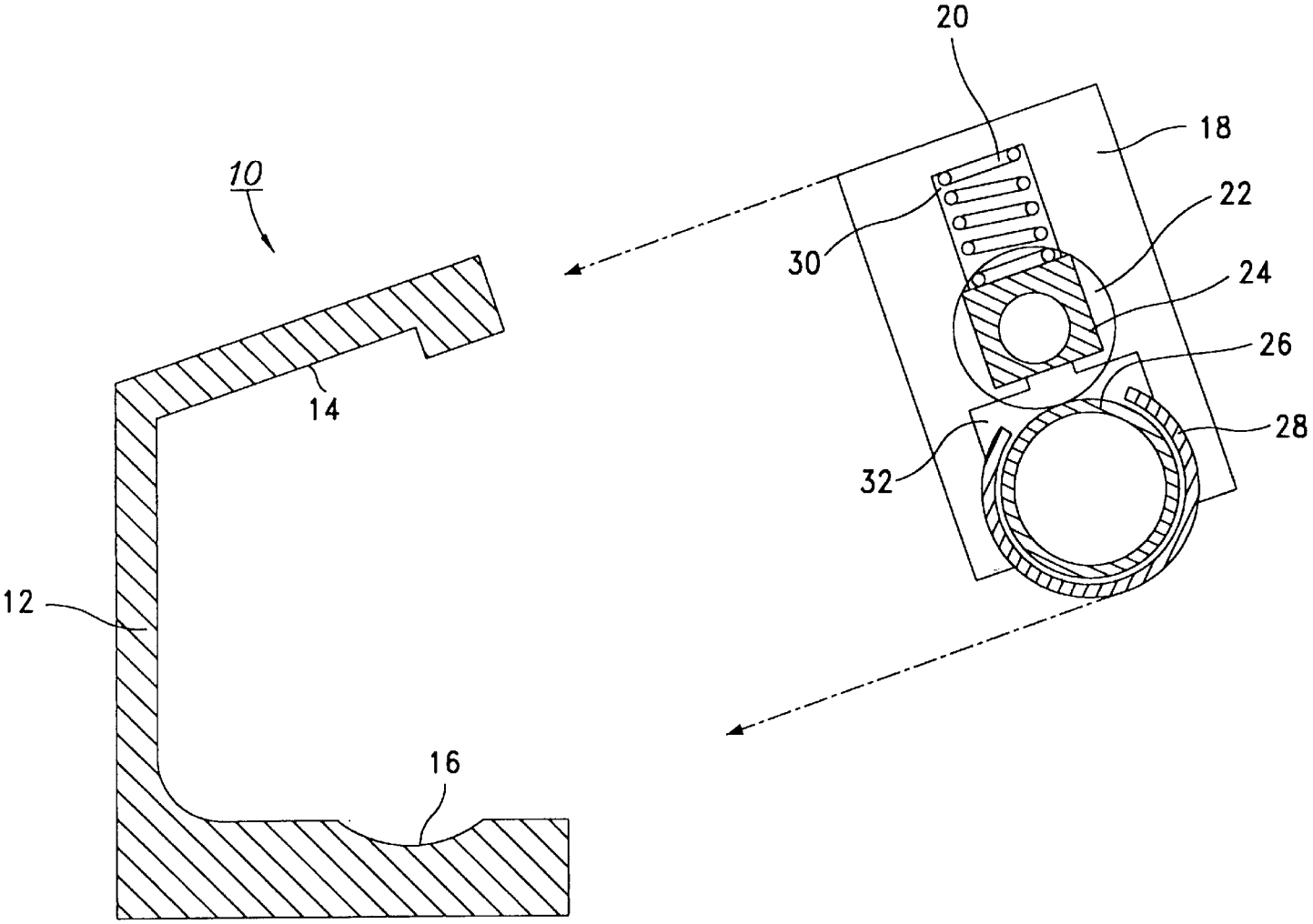
FIG. 3 is a schematic side view of the heating roll and pressure roll in the one piece frame of a fixing device.
Figure 4:
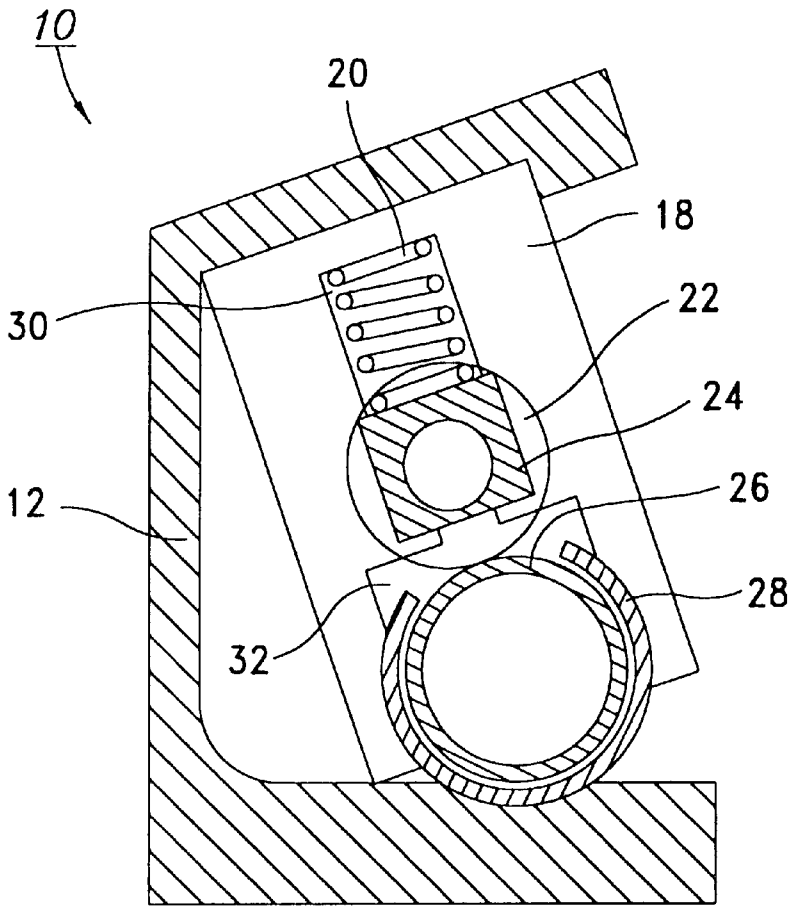
FIG. 4 is a schematic side view of the toner fixing device of FIG. 3 attached to its mounting bracket.

FIG. 3 illustrates the preferred embodiment of a fixing device 10 and mounting bracket 12. The heating roll 26 and a pressure roll 2 are attached to one piece frames 18 which can be mounted onto mounting brackets 12. One of one piece frames 18 is attached to each end of the developer rolls to enable the rollers to be inserted into mounting brackets 12 that are attached to the electrophotographic device. While this specification discusses the use of two brackets, one for each one piece frame that is attached to the rollers, it does not matter whether two brackets are used or whether one larger bracket that is capable of engaging both one piece frames at once is used. The frames 18 have a slot blind 30 that accommodates the presence of spring 20. The spring acts on the pressure roller 22 to press a toner image into a sheet of paper 84. Both ends of the pressure roll 22 have abrasion resistant pads 24 to prevent abrasion from the frame due to the rotation of the pressure roll 22. The frames 18 is also provided with a lower perforation 32 for supporting the heating roll 26, which fuses the toner image onto the paper 84. The heating roll 26 contains a halogen lamp (not shown) to generate the heat necessary to melt the toner into the paper. Both ends of the heating roll 26 have abrasion resistant lining 28 to prevent abrasion due to the rotation of the heating roll 22. The lower perforation 32 is designed so that part of the heating roll 26 will protrude past the edge of the frame. The slot 30 and the lower perforation 32 overlap to form a single slot of two different widths.

The fixing device mounting brackets 12 are formed so that they will firmly hold the one piece frames 18. The inside of the bracket has an upper locking recess 14 for locking the upper part of the one piece frames 18 and a lower semi-circular groove 16 for receiving the abrasion resistant lining 28 that is attached to the heating roll 26.

To assemble the fixing device a spring 20 is attached to a slot 30 in the one piece frames 18 and abrasion resistant pads 24 are attached to both ends of the pressure roll 22, which is then attached to the one piece frames. The heating roll 26 is then attached, along with the abrasion resistant liner 28, to the lower perforation 32 of the one piece frames 18. Then, the one piece frames 18 is inserted into the mounting bracket 12 so that the abrasion resistant liner 28 of the heating roll 26 occupies the lower semi-circular groove 16 and so that the upper part of the one piece frames; 18 is locked in the upper locking recess 14.

This heat and pressure fixing device uses one piece frames to support the ends of the rollers. The frames have slots in them where springs are located which increase the pressure between the rollers. The one piece frames are designed so as to interlock with a bracket inside the electrophotographic apparatus. The use of the one piece frame should increase the dimensional precision of the manufactured fixing devices. In addition, the use of mounting brackets should simplify the image forming apparatus manufacturing process.

Although one preferred embodiment of the present invention has been disclosed for illustrative purposes, those skilled in the art will appreciate that various modifications, additions and substitutions are possible, without departing from the scope and spirit of the invention as disclosed in the accompanying claims. It is also possible that other benefits or uses of the currently disclosed invention will become apparent over time.

What is claimed is:

1. A fixing device for an electrophotographic apparatus, comprising:

a body of said electrophotographic apparatus, said body having a plurality of mounting brackets;

a plurality of frames each formed of a unitary structure and detachably mounted on a different and corresponding one of said plurality of mounting brackets, said plurality of frames forming a plurality of sides of said fixing device;

a heating roll rotatably attached to each of said frames; and a pressure roll rotatably mounted in each of said frames.

2. A fixing device according to claim 1, with said plurality of mounting brackets each having a U-shaped perforation.

3. A fixing device according to claim 1, with each of said frames comprising:

a rectangular body;

a first slot in said rectangular body, said rectangular body having a second slot adjacent to said first slot;

a spring attached at one end to an inside of each of said plurality of frames on a surface bordering one end of said second slot, a second end of said spring being attached to said pressure roll; and said heating roll being attached to said first slot.

4. A fixing device according to claim 1, with each of said plurality of mounting brackets having a channel forming a U-shaped section and having an upper locking recess for engaging an upper part of one of said plurality of frames, said plurality of mounting brackets each having a lower semi-circular groove accommodating a protruding portion of said heating roll, said protruding portion extending from one of said plurality of frames.

5. A fixing device according to claim 1, with said pressure roll having a plurality of abrasion resistant pads on each end positioned between each of said plurality of frames and said pressure roll.

6. A fixing device according to claim 1, with said heating roll having an abrasion resistant lining positioned between said heating roll and each of said plurality of frames and said plurality of mounting brackets.

7. A fixing device for use with an electrophotographic apparatus, comprising:

said fixing device having two distal ends, said ends each formed by one of a plurality of frames, said plurality of frames each being formed of a unitary structure and having a rectangular body comprising a first slot in said rectangular body and a second slot adjacent to said first slot;

a spring attached at one end to an inside of each of said plurality of frames on a surface bordering one end of said second slot, a second end of said spring being attached to a pressure roll, said pressure roll rotatably supported by each of said plurality of frames; and a heating roll rotatably attached to each of said plurality of frames, said heating roll being located in said first slot of each of said plurality of frames.

8. A fixing device according to claim 7, with each of said plurality of frames interlocking with one of a plurality of mounting brackets, said plurality of mounting brackets attached to said electrophotographic apparatus.

9. A fixing device according to claim 7, with each of said plurality of frames interlocking with one of a plurality of mounting brackets, said plurality of mounting brackets each comprising:

A body bearing a channel forming a U-shaped section, having an upper locking recess engaging an upper part of one of said plurality of frames, said plurality of mounting brackets each having a lower semi-circular groove accommodating a protruding portion of said heating roll, said protruding portion extending from each of said plurality of frames.

10. A fixing device according to claim 7, with said pressure roll having a plurality of abrasion resistant pads on each end positioned between each of said plurality of frames and said pressure roll.

11. A fixing device according to claim 7, with said heating roll having an abrasion resistant lining positioned between said heating roll and each of said plurality of frames and said plurality of mounting brackets.

12. An image forming apparatus, comprising:

an apparatus body enclosing a plurality of mounting brackets;

a fixing device detachably mounted on said plurality of mounting brackets, said fixing device comprising:

a body for said fixing device attached to said plurality of mounting brackets;

a plurality of frames, each formed of a unitary structure, forming a plurality of sides of said body, said plurality of frames each being located on one of a plurality of ends of said body for said apparatus, said plurality of frames each having a rectangular shape bearing a first slot and a second slot adjacent to said first slot; and a spring attached at one end to an inside of each of said plurality of frames on a surface bordering one end of said second slot.

13. An image forming apparatus according to claim 12, with said fixing device further comprising:

a pressure roll attached to a second end of said spring, said pressure roll being supported by each of said plurality of frames; and a heating roll rotably attached to each of said plurality of frames.

14. An image forming apparatus according to claim 13, with said pressure roll having a plurality of abrasion resistant pads on each end positioned between each of said plurality of frames and said pressure roll.

15. An image forming apparatus according to claim 13, with said heating roll having an abrasion resistant lining positioned between said heating roll and each of said plurality of frames and said plurality of mounting brackets.

16. An image forming apparatus, comprising:

a fixing device comprising a heating roll;

an apparatus body supporting a plurality of mounting brackets each comprising a bracket body bearing a channel forming a U-shaped section, said plurality of mounting brackets each having an upper locking recess for engaging an upper part of one of a plurality of frames each formed of a unitary structure, each of said plurality of mounting brackets having a lower semi-circular groove accommodating a protruding portion of said heating roll, said protruding portion protruding from each of said plurality of frames; and said fixing device being detachably mounted on each of said plurality of mounting brackets.

* * * * *